US005829859A

United States Patent [19]

Cram

[11] Patent Number: 5,829,859

[45] Date of Patent: Nov. 3, 1998

[54] BI-DIRECTIONAL DRAWER SYSTEM

[75] Inventor: Ronald Cram, Whittier, Calif.

[73] Assignee: Planhold Corporation, Irvine, Calif.

[21] Appl. No.: 727,851

[22] Filed: Oct. 4, 1996

[51] Int. Cl.[6] ..... E05C 7/06

[52] U.S. Cl. ..... 312/221; 312/219; 312/218; 312/283

[58] Field of Search ..... 312/216, 217, 312/218, 221, 283, 286, 287, 219

[56] References Cited

U.S. PATENT DOCUMENTS

| | | | |
|---|---|---|---|
| 3,622,216 | 11/1971 | Haunost | 312/219 |
| 4,272,138 | 6/1981 | Stark | 312/216 X |
| 4,637,667 | 1/1987 | Reid et al. | 312/216 X |
| 4,865,404 | 9/1989 | Harper | 312/219 X |
| 5,333,949 | 8/1994 | McGregor | 312/221 |
| 5,411,327 | 5/1995 | Norton | 312/221 |
| 5,497,878 | 3/1996 | Sandonato | 312/281 X |

*Primary Examiner*—Peter M. Cuomo
*Assistant Examiner*—Stephen Vu
*Attorney, Agent, or Firm*—Schweitzer Cornman Gross & Bondell LLP

[57] ABSTRACT

A drawer system with an improved drawer interlock mechanism has a frame which slidably supports at least one drawer and at least one column of locking bars, perpendicular to the movement of the drawer. Each drawer includes a cam associated with a set of cam followers disposed on facing ends of adjacent locking bars. Each drawer cam is normally aligned to separate its associated set of cam followers and the associated locking bars when the drawer is opened, thereby displacing all locking bars in the column. The displaced locking bars misalign the cam followers associated with unopened drawers thereby preventing them from opening. Bias means returns the column of locking bars to a normal rest position when the drawer is retracted. A locking cam can be actuated to displace all locking bars toward said bias means to prevent all drawers from opening. Separate interlocking mechanisms can be located adjacent diagonal corners of the frame so that drawers can be interchangeably oriented to operate from one of two faces in an independent fashion.

5 Claims, 5 Drawing Sheets

BI-DIRECTIONAL DRAWER SYSTEM

FIELD OF THE INVENTION

The present invention relates to drawer systems and the like and in particular to such a unit incorporating a locking and control system for the extension of drawers.

BACKGROUND OF THE INVENTION

The incorporation of mechanical locking systems to secure drawers in the closed position and to prevent the simultaneous extension of multiple drawers is well known. Particularly in office environments, vertical file systems having a plurality of stacked drawers require the use of such a system to both lock the drawers against unwanted access and to serve as a safety mechanism. The simultaneous extension of more than one drawer, particularly when the drawer is loaded, may result in instability of the cabinet unit, causing the cabinet unit to pivot forward about its lower front edge, resulting in loss of the drawer contents, possible damage to the extended drawers, as well as physical injury to the user. Previous designs approach this problem by employing systems with safety and locking devices also known as interlock mechanisms. These mechanisms are generally effective, however, they are typically complicated and are only suitable for conventional cabinet designs.

Conventional cabinet design and construction provides for the array of drawers to be accessible from a first side of the cabinet. Because of the aforementioned concern when multiple drawers are attempted to be accessed simultaneously, such "one face" designs limit accessibility to one drawer at a time. In addition, the placement of such a file cabinet in a centralized location may result in the inefficient use of space; although the rear cabinet surface may be exposed, access to the files can only be accomplished through the opposed "front" face.

Therefore, what is desired is a drawer system which is operable from both the front and back face of a cabinet and which includes an improved independent interlock mechanism for each face.

SUMMARY OF THE INVENTION

Accordingly, it is a purpose of the present invention to provide a drawer system, such as for a file cabinet, having an improved drawer interlocking mechanism.

A further purpose of the present invention is to provide a drawer system in which individual drawers may be oriented in a manner which allows them to be accessible from either a first or second direction.

Still a further purpose of the present invention is to provide such a multiple access drawer system with independent interlocking mechanisms for the drawers (oriented in each direction.

Yet another purpose of the present invention is to provide such a drawer system in which the drawers oriented in a first direction may be locked and opened independently of those oriented in a second direction.

Yet still another purpose of the present invention is to provide such a drawer system which is of a modular design, permitting a variety of drawers to be stacked with a minimum of differing locking system components.

These and other objects are realized by a drawer system having a frame with at least one drawer slidably mounted thereto. The drawer system includes an interlocking mechanism having a column of individual locking bars slidably mounted to the frame in an end-to-end relationship, perpendicular to the movement of the drawer. Each drawer includes a drawer cam which, when the drawer is opened, separates a set of cam followers attached to opposing ends of adjacent locking bars, thereby separating two of the locking bars. The separated locking bars displace other locking bars in the column thereby misaligning their cam followers and temporarily blocking the path of the other drawer cams and preventing the other drawers from opening. The interlocking mechanism also includes a means to bias the column of locking bars in a rest position such that, when the drawer is closed, the column of locking bars returns to the rest position and is properly aligned so that another drawer may be opened. The interlocking mechanism can also include a key-operated lock which displaces all locking bars in the column thereby blocking the path c)f all drawer cams and preventing all drawers from opening. Two independent interlocking mechanisms can be located on opposite diagonal corners of one frame such that drawers oriented toward one side of the frame can be operated and locked independently of those oriented toward the other.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE INVENTION

Figure 1:
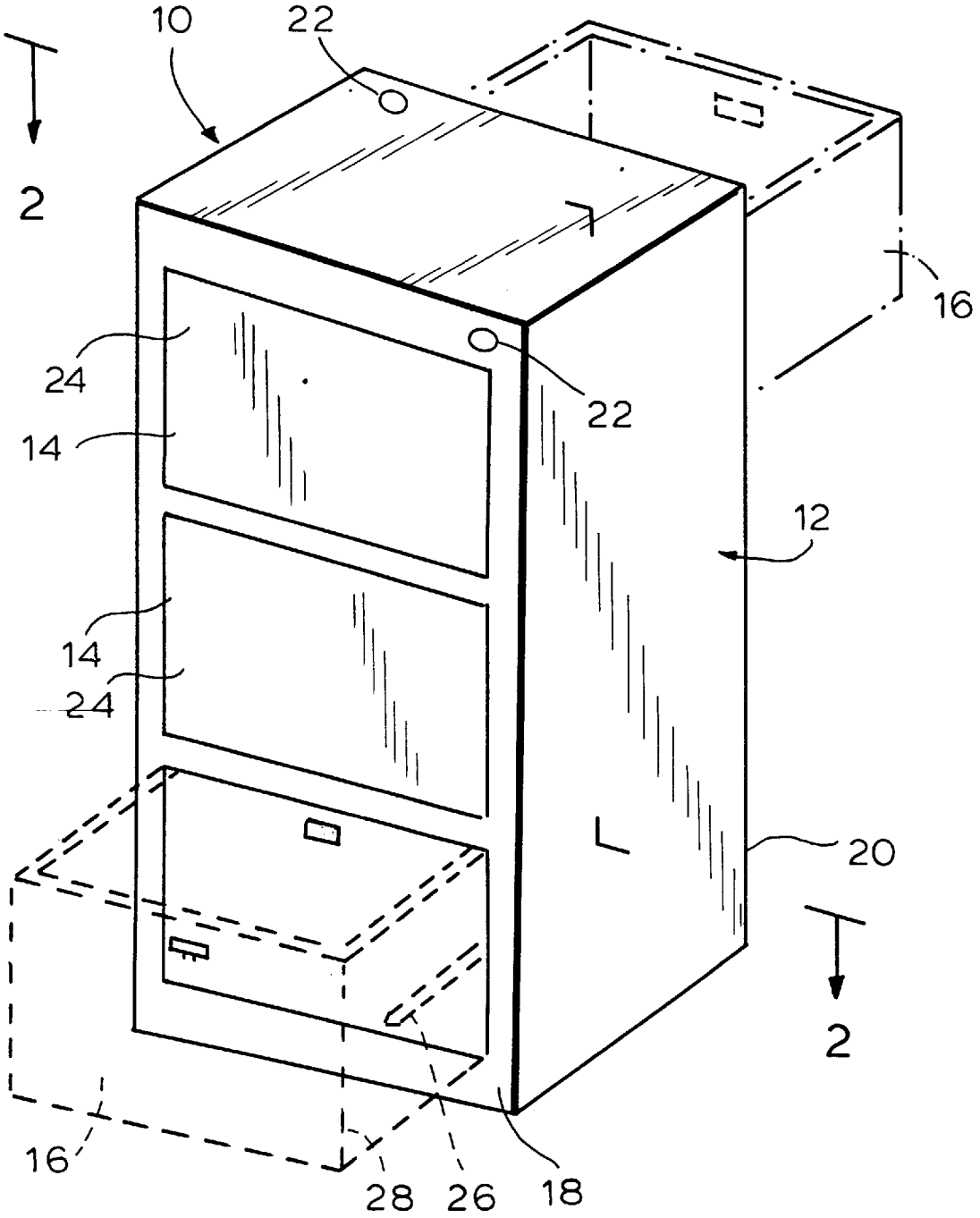
FIG. 1 is a perspective view of a file cabinet incorporating a drawer system according to the present invention showing drawers oriented to open from both faces of the cabinet.

Referring to FIG. 1, a drawer system 10, constructed in accordance with the invention, may be in the form of a file cabinet with a frame 12 having a plurality of drawer apertures 14 and one or more sliding drawers 16 mounted therein. The drawers 16 are slidably mounted on drawer supports (hidden) which allow the drawers to slide out through the apertures 14 in the frame 12. The drawer system 10 can be assembled with the drawers 16 oriented toward one of two faces 18, 20 which allows the drawer system 10 to be accessed from the first face 18, or the second face 20, or possibly both. The drawer system 10 includes at least one, but preferably two independent, interlocking mechanisms 29 (hidden), each including a manual key-operated locking mechanism 22, or the like.

The function of the locking mechanism 22 component of the interlocking mechanism 29 is to lock all drawers on the side in a close position. The balance of the interlocking mechanism 29 also serves the further function of preventing more than one drawer on the side from opening at a time.

The interlocking mechanisms 29 preferably only control the drawers of one face so that the drawers 16 of the two sides or faces 18, 20 of a single file cabinet can be operated independently of one another. Thus, if desired, access to the two sides can be divided among different groups or departments within one organization.

To enhance security and aesthetics, cover panels 24 can be inserted in the frame 12 to close off the apertures 14 behind each drawer 16. Also, each drawer 16 includes a drawer cam 26 located on the side 28 thereof. As will be further discussed below, when the drawer is opened, the drawer cam 26 engages the drawer interlock mechanism 29 (hidden) in the frame 12. The interlocking mechanism 29 prevents any other drawers on the same side from opening.

Figure 2:
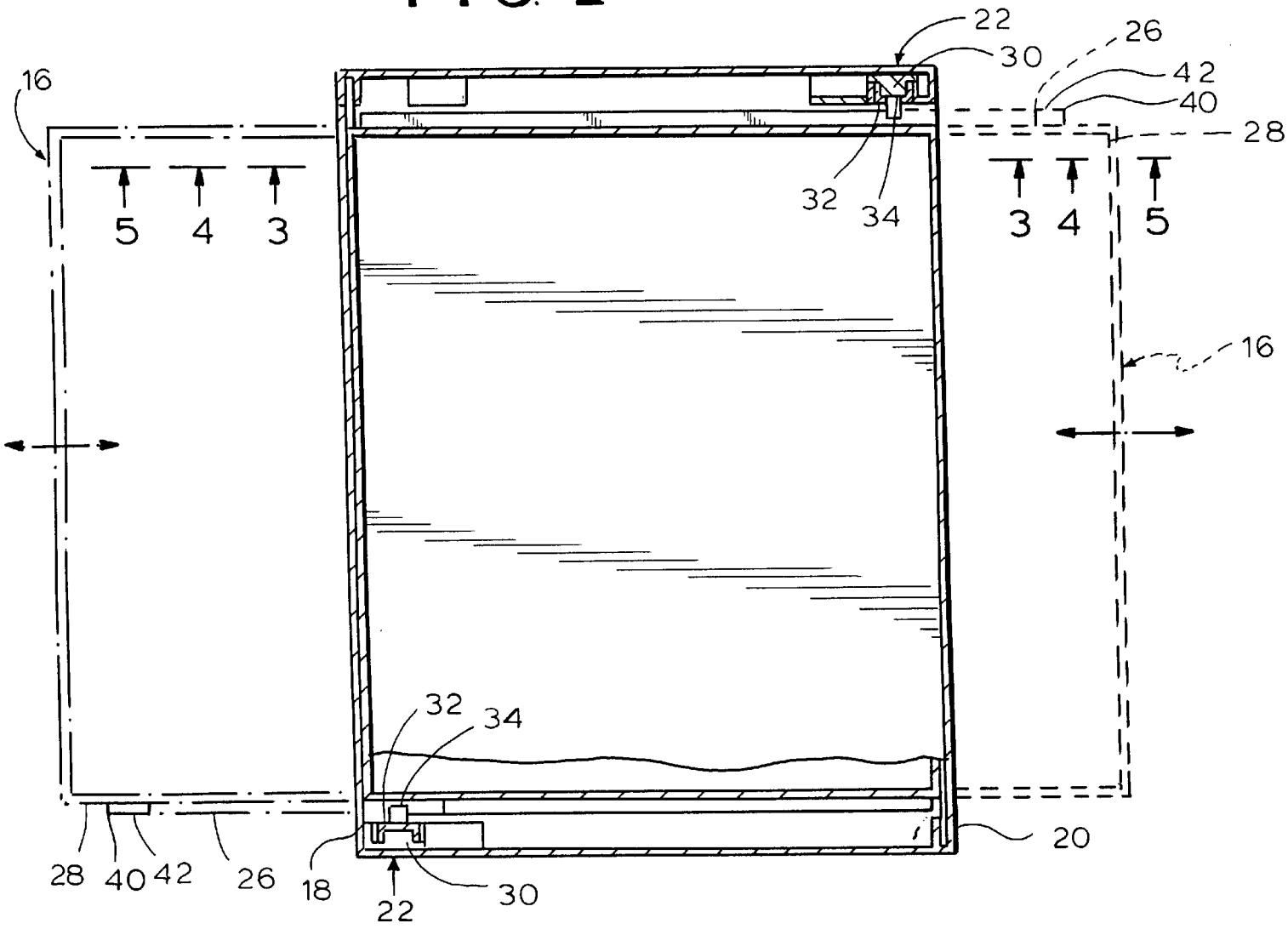
FIG. 2 is a cross-sectional plan view taken along line 2—2 of FIG. 1 showing the independent interlocking mechanisms located adjacent diagonal corners of the cabinet.
Figure 3:
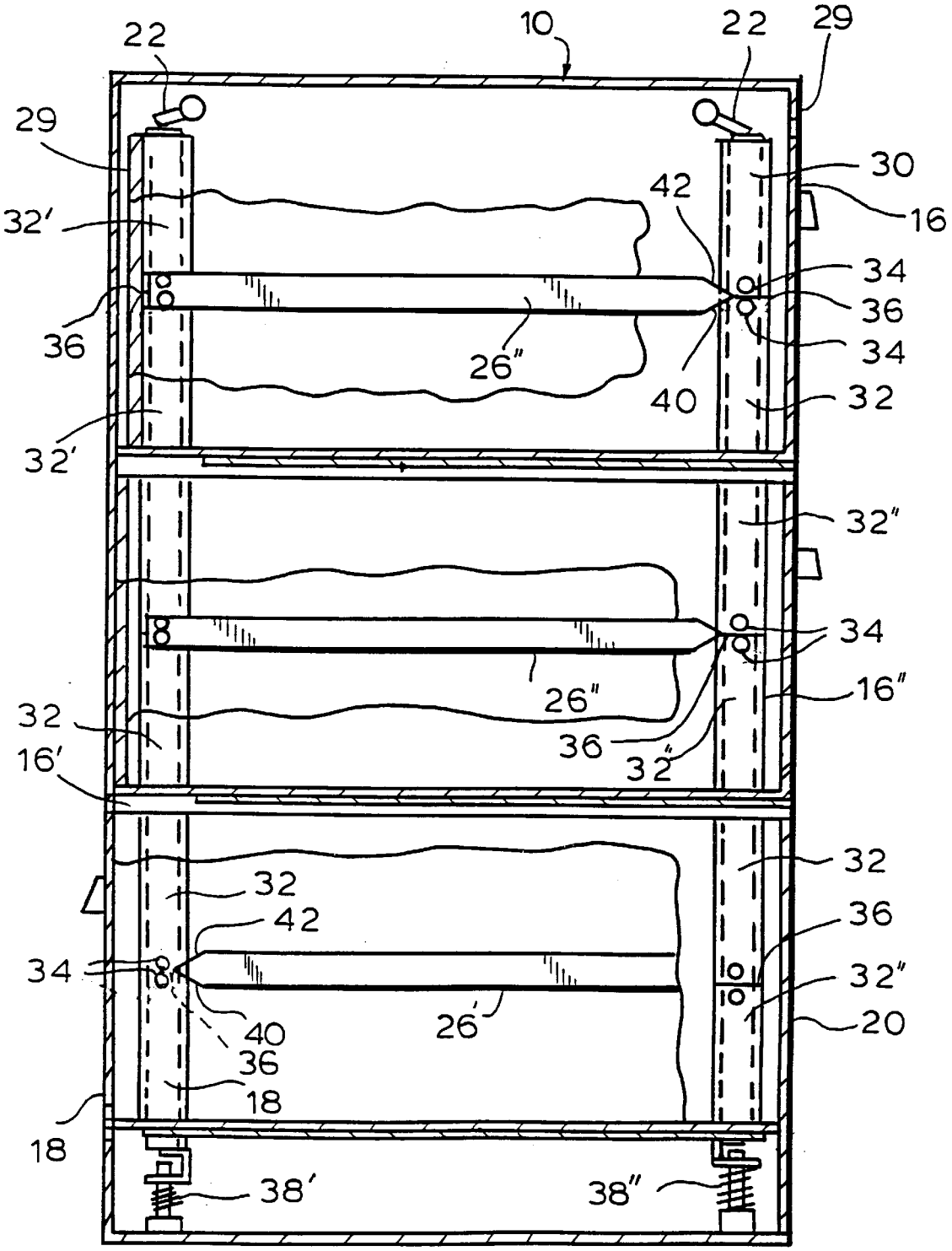
FIG. 3 is a cross-sectional elevation view taken along line 3—3 of FIG. 2 showing the locking bars of the interlocking mechanisms in unlocked, rest positions.

Referring to FIG. 2 and 3, each interlock mechanism 29 preferably includes a column of individual locking bars 32 slidably mounted to the frame by support means 30 in an end-to-end relationship, perpendicular to the movement of the drawer. As depicted, the support means 30 can be in the form of a vertical channel, however other means such as rods or rails are also within the contemplation of the invention. Also, as best seen in FIG. 2, the locking bars 32 may be U-shaped in cross-section.

The locking bars 32 include cam followers 34 attached to opposed ends thereof. There is preferably one set of two cam followers 34 associated with each drawer 16. There is also preferably a pair of locking bars 32 associated with each drawer 16. The cam followers 34 are preferably symmetrically disposed adjacent opposed ends 36 of the locking bars 32 and are slightly spaced apart forming a gap into which a leading edge 40 of the drawer cam 26 may enter. The cam followers 34 can be in the form of rollers but may be of any other suitable configuration, including but not limited to pegs, rods, arms, or simply integral extensions of the locking bars 32 themselves.

Each drawer cam 26 is aligned parallel to the direction of movement of the drawer and is preferably in the form of an elongated rectangle with one or more inclined surfaces 42 adjacent the leading edge 40 thereof. The drawer cam 26 is normally aligned to separate an associated set of cam followers 34 when the associated drawer 16 is opened. When the drawer 16 is opened, the leading edge 40 and inclined surfaces 42 of the drawer cam 26 separate the cam followers 34. This separates the associated locking bars 32 and causes the displacement of the other locking bars 32. As will be further described below, the displaced locking bars 32 prevent other drawers on the same side from opening.

As best seen in FIG. 2, preferably, the two interlocking mechanisms 29 are located adjacent diagonal corners of the frame 12 such that they are positioned to cooperate with the drawer cams 26 of drawers 16 oriented toward one of the two faces 18, 20. Also, preferably, all drawers 16 are of a substantially identical design, having one drawer cam 26 located on the same side 28 thereof. Thus, regardless of the side 18, 20 toward which a drawer 16 is oriented, its drawer cam 26 will engage the appropriate interlocking mechanism 29.

Figure 4:
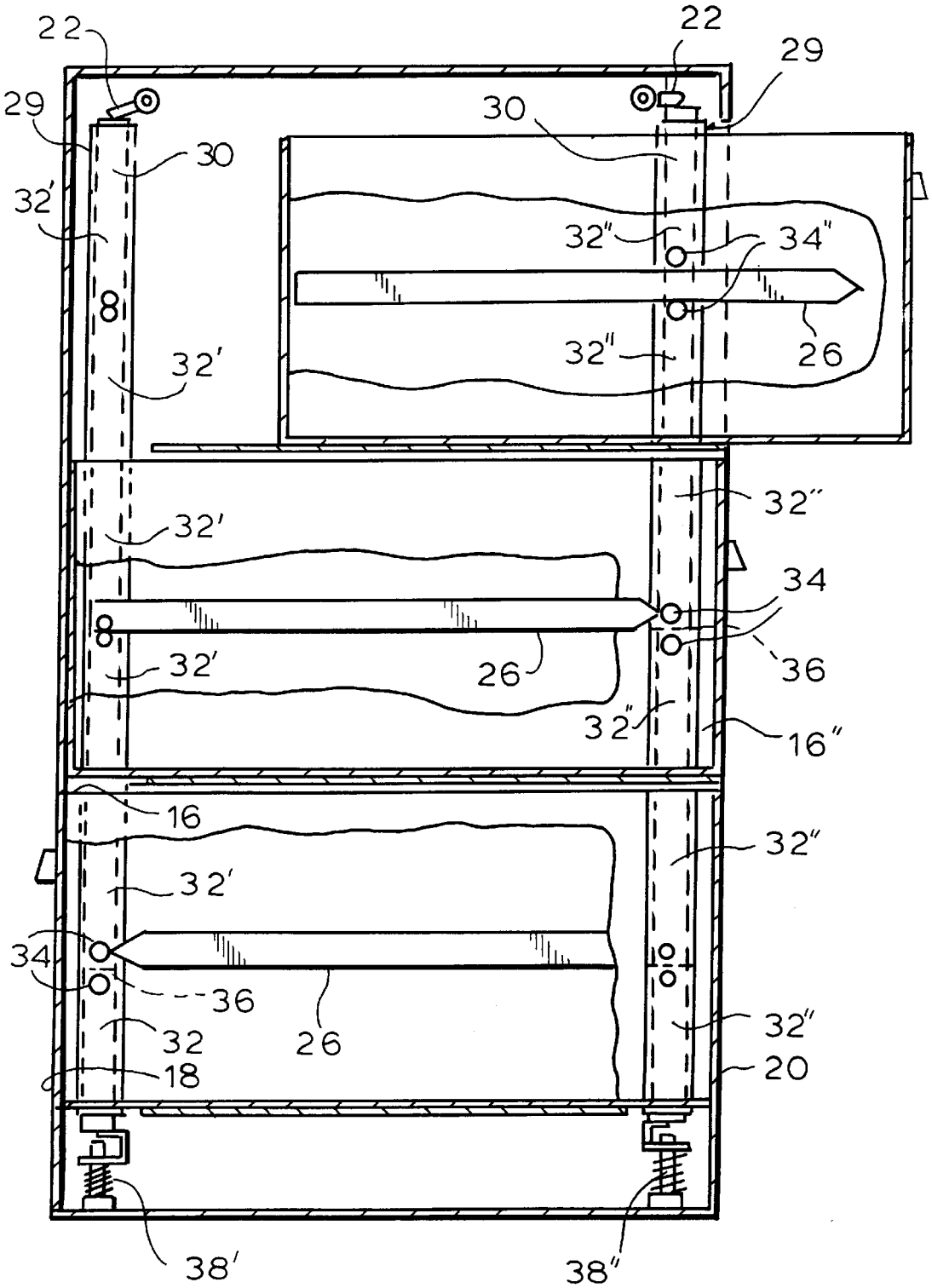
FIG. 4 is a cross-sectional elevation view taken along line 4—4 of FIG. 2 showing the locking bars displaced, on one side, by a drawer cam and, on the other side, by the locking cam.

Referring to FIG. 4 the locking bars 32 can be moved from their rest positions to displaced positions by either opening a drawer or actuating the locking mechanism 22, here depicted as a manually-activated cam. In either case, the displaced locking bars 32 prevent any closed drawers from opening. As shown in this FIG. 4, the locking bars 32' associated with one side 18 are displaced by operation of the associated locking mechanism 22', while the locking bars 32" of the other side 20 are displaced by the drawer cam 26" of the opened drawer 16".

All of the locking bars 32' displaced by the locking mechanism 22' are moved downward against an opposite bias such as that provided by a spring 38', located below the column of locking bars 32'. In an analogous manner, the locking bars 32" below the drawer cam 26" of the opened drawer 16" are similarly moved downwards against another spring 38", while any locking bars above the cam 26" of the opened drawer 16" (here only one) are moved upward and are maintained in a contacting relationship with the drawer cam 26" by gravity. It should be noted that while the biasing means depicted are in the form of mechanical coil springs 38, any other biasing means such as levers, rubber, other resilient material, or any other type of passive or active actuator is within the scope and spirit of the present invention.

When the locking bars 32' and 32" are displaced, the associated cam followers 34' and 34"' are misaligned with the associated drawer cams 26' and 26"' of the unopened drawers 16' and 16"'. Therefore, these drawers cannot open, as outwardly-directed motion of the drawer cams (and hence the drawers) is blocked by the locking bars 32', 32". When the locking mechanism 22' is disengaged, the spring 38' lifts the column of locking bars 32' back into the rest position in which the cam followers 34 are once again aligned with their respective drawer cams (see FIG. 3). Similarly, when the opened drawer 16" is closed and the drawer cam 26" is thereby withdrawn from between the associated cam followers 34", the spring 38" returns the previously downwardly-displaced locking bars 32" to the rest position, while the locking bar(s) previously above the withdrawn drawer cam 26" falls by force of gravity into its rest position in contact with and thus directly adjacent the locking bar below.

Figure 5:
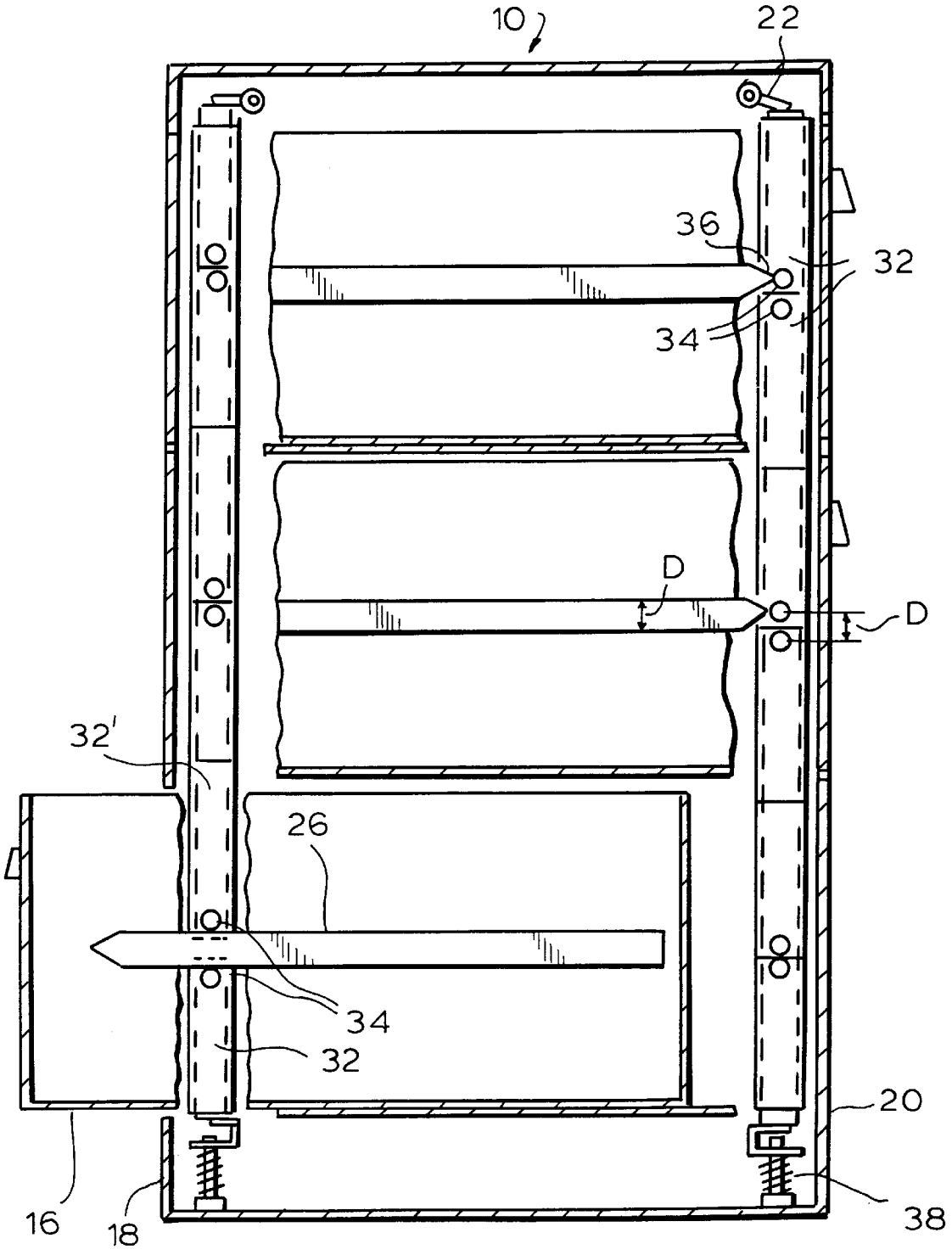
FIG. 5 is a cross-sectional elevation view taken along line 5—5 of FIG. 2.

As may be seen by comparing FIGS. 4 and 5, the present invention provides for similar and independent drawer control for each opposed face 18, 20. That is, when all drawers 16 of any one side are closed, the locking mechanism 22 of that side may be engaged to prevent any drawer 16 on the side from opening, however the drawers 16 of the other side remain operable. Similarly, when one drawer 16 on a side is opened, all other drawers 16 on that side cannot open, however the drawers 16 of the opposite side can be opened or locked as desired.

Referring to FIGS. 4 and 5, when either a locking mechanism 22 is engaged or a drawer 16 is opened, preferably the locking bars 32 are displaced such that the extreme ends 40 of the drawer cams 26 of the unopened drawers 16 are misaligned with their respective cam followers 34 and thus will not separate the associated locking bars 32. For example, if the cam followers are cylindrically-shaped (e.g. in the form of rollers as depicted), the misaligned drawer cams 26 would need be at or beyond a point of normality with one of the associated cam followers 34. In this situation, the drawer cam 26 would not serve to separate the locking bars 32. Instead, if the drawer cam 26 were aligned normal to the cam followers 34 (as shown in FIGS. 4 and 5), the drawer cam 26 would not urge the locking bars 32 in either direction, it would simply apply pressure to the locking bars 32 in a direction perpendicular to the support means 30. That is, in a direction in which the locking bars 32 cannot move. Alternatively, if the drawer cam were aligned outside the point of normality, the drawer cam 26 would attempt to push one locking bar toward the other. In either case, the locking bars 32 and associated cam followers 34 will not allow the drawer cam 26 to pass and the drawer 16 will be (temporarily) locked closed.

Preferably, the cam followers 34 of each set are normally spaced symmetrically adjacent the facing ends 36 of the locking bars 32, at a distance of D between corresponding portions thereof. For example, if the cam followers 34 were of the form of rollers, then their centers would, under normal (or rest) conditions, be spaced at a distance of D. Also, preferably, the drawer cams 26 include a substantially rectangular portion having a width greater than or equal to the distance D between corresponding portions of the cam followers 34. This insures that the cam followers 34" associated with unopened drawers 16" will be sufficiently misaligned with the drawer cams when one drawer is opened. Similarly, preferably the locking mechanism 22 displaces the locking bars 32 a distance greater than or substantially equal to one-half of the distance D between corresponding portions of the cam followers 34 thereby sufficiently misaligning the cam followers 34 and preventing the drawers from opening.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A bi-directional drawer system comprising:

(a) a frame having two opposed faces;

(b) two drawers slideably supported by said frame, each mounted for operation from one of said faces;

(c) two independent interlocking means, each associated with one of said faces;

(d) each interlocking means comprising:

(i) a support means;

(ii) a pair of locking bars slideably supported by said support means;

(iii) a set of cam followers disposed adjacent facing ends of said locking bars;

(iv) a locking cam; and (v) means for biasing said locking bars into a rest position;

(e) each drawer having a side with a drawer cam adapted to separate an associated set of cam follower means and locking bars when the drawer is opened;

(f) each set of cam follower means being substantially symmetrically disposed on the associated pair of locking bars, and each drawer cam having a substantially rectangular portion with a width at least equal to a distance between corresponding portions of said sets of cam follower means;

(g) each locking cam being operable to urge one of said pairs of locking bars into a locking position, wherein relative to said rest position, said one pair of locking bars is displaced from the rest position, and wherein one of said sets of cam follower means is displaced relative to an associated drawer cam;

(h) each locking cam being operable to displace an associated pair of locking bars a distance at least substantially equal to one-half said distance between corresponding portions of said sets of cam follower means; and (i) said two interlocking means being located adjacent opposed, diagonal corners of said frame such that said first and second drawers can be alternately mounted for operation and locking from either said first face or said second face.

2. A bi-directional drawer system as in claim 1, wherein:

(a) said first and second drawers are operable from first and second faces, respectively;

(b) said drawer system further comprises a third drawer operable from said first face; and (c) one of said interlocking means is associated with said first face and comprises first and second sets of locking bars associated with said first and third drawers, respectively; each set of locking bars having a set of cam followers disposed adjacent facing ends of said locking bars;

(d) said third drawer has a side with a drawer cam adapted to separate the associated set of cam followers; and (e) said interlocking means associated with said first face is operable to prevent the simultaneous opening of said first and third drawers.

3. A bi-directional drawer system comprising:

(a) a frame having first and second faces;

(b) first and second interlocking means, each comprises of two bars slideably mounted to said frame in an end-to-end column configuration, said column having a rest position in which said two bars are abutting one another, a cam follower connected to each bar, means to bias said column of bars in said rest position, and locking means to displace said column of bars from said rest position a distance at least equal to half a distance between corresponding portions of said cam followers;

(c) said frame having opposed diagonal corners, said first and second interlocking means being associated with said first and second faces of said frame, respectively, and each being disposed adjacent an opposite one of said diagonal corners;

(d) first and second drawers slideably mounted to said frame, each drawer having a cam on a side thereof, said cam being adapted to separate said cam followers of one of said first and second interlocking means from the rest position when the drawer associated with said cam is opened; and (e) said first and second drawers being adapted to be alternatively mounted for operation from either said first face or said second face.

4. A bi-directional drawer system as in claim 3 wherein:

(a) said first and second drawers are operable from first and second faces, respectively;

(b) said drawer system further comprises a third drawer operable from said first face; and (c) one of said interlocking means is associated with said first face and comprises first and second sets of locking bars associated with said first and third drawers, respectively; each set of locking bars having a set of cam followers disposed adjacent facing ends of said locking bars;

(d) said third drawer has a side with a drawer cam adapted to separate the associated set of cam followers; and (e) said first interlocking means associated with said first face is operable to prevent the simultaneous opening of said first and third drawers.

5. A bi-directional drawer system, comprising:

(a) a frame having first and second opposed faces;

(b) an independent drawer interlocking means associated with each face, said independent interlocking means being substantially identical and located adjacent opposed, diagonal corners of said frame, each interlocking means comprising:

(i) a pair of locking bars slideably supported by said frame;

(ii) a set of cam follower means associated with said locking bars;

(iii) a means for biasing said pair of locking bars into a rest position; and (iv) a locking cam operable to displace said pair of locking bars into a locking position;

(c) first, second and third drawers slideably supported by said frame, said first and third drawers being operable from said first face and said second drawer being operable from said second face;

(d) each of said first, second and third drawers being substantially identical and including a drawer cam disposed along a side thereof, said drawer cam being adapted to engage an associated set of cam follower means;

(e) one of said interlocking means being associated with said first face and comprising first and second sets of locking bars associated with said first and third drawers, respectively, each set of locking bars having a set of cam followers disposed adjacent facing ends of said locking bars;

(f) said first interlocking means associated with said first face being operable to prevent the simultaneous opening of said first and third drawers; and (g) said first and second drawers being adapted to be alternatively mounted for operation from either said first face or from said second face.

* * * * *